US005806814A

United States Patent [19]

White

[11] Patent Number: 5,806,814

[45] Date of Patent: Sep. 15, 1998

[54] WATER HOSE CADDY

[76] Inventor: Harold L. White, 10565 6th Ave., Inglewood, Calif. 90303-1624

[21] Appl. No.: 655,065

[22] Filed: May 29, 1996

[51] Int. Cl.[6] ..... A47G 29/00

[52] U.S. Cl. ..... 248/80; 248/76; 248/176.1; 137/355.16

[58] Field of Search ..... 248/80, 89, 90, 248/176.1, 75, 76; 137/355.18, 355.16

[56] References Cited

U.S. PATENT DOCUMENTS

| | | | |
|---|---|---|---|
| D. 263,903 | 4/1982 | Johnston | D6/112 |
| D. 306,681 | 3/1990 | Toca, III | D8/1 |
| 357,900 | 2/1887 | Boyle | 137/355.18 |
| 2,354,631 | 7/1944 | Williamson | 137/355.18 |
| 2,687,792 | 8/1954 | Laugle, Sr. | 193/37 |
| 4,211,259 | 7/1980 | Butler | 138/109 |
| 4,506,698 | 3/1985 | Garcia et al. | 137/355.26 |
| 4,512,361 | 4/1985 | Tisbo et al. | 137/355.27 |
| 4,586,676 | 5/1986 | Johnston et al. | 242/86 |
| 4,700,737 | 10/1987 | Nelson | 137/355.27 |
| 4,836,479 | 6/1989 | Adams | 248/89 |
| 4,903,922 | 2/1990 | Harris, III | 248/75 |
| 4,934,625 | 6/1990 | Richardson | 242/85.1 |
| 4,974,627 | 12/1990 | Nelson | 137/355.27 |
| 5,005,790 | 4/1991 | Harris, III | 248/75 |
| 5,011,034 | 4/1991 | Abel | 220/23.86 |
| 5,090,647 | 2/1992 | Clarke | 248/87 |
| 5,402,814 | 4/1995 | Odom | 137/15 |
| 5,419,497 | 5/1995 | Warrington | 239/722 |

*Primary Examiner*—Ramon O. Ramirez
*Assistant Examiner*—Gwendolyn W. Baxter
*Attorney, Agent, or Firm*—Fulbright & Jaworski

[57] ABSTRACT

An apparatus for storing a hose between periods of use, such as a water hose or other elongated flexible member, which includes right and left support arms, right and left rotatable support members, cross bar, right and left support posts, neck portion and base leg. The right and left rotatable support members are freely rotatable about said right and left support arms, thus allowing said hose to be freely uncoiled, and manufactured from polyvinyl chloride piping. The water hose support apparatus is mounted at three points such that it is securely supported in a vertical and horizontal position, and is preferably manufactured from galvanized pipe, and is constructed such that it can support the weight of the water hose and its contents when fully wrapped without any sagging or other failure.

16 Claims, 2 Drawing Sheets

FIG. 1
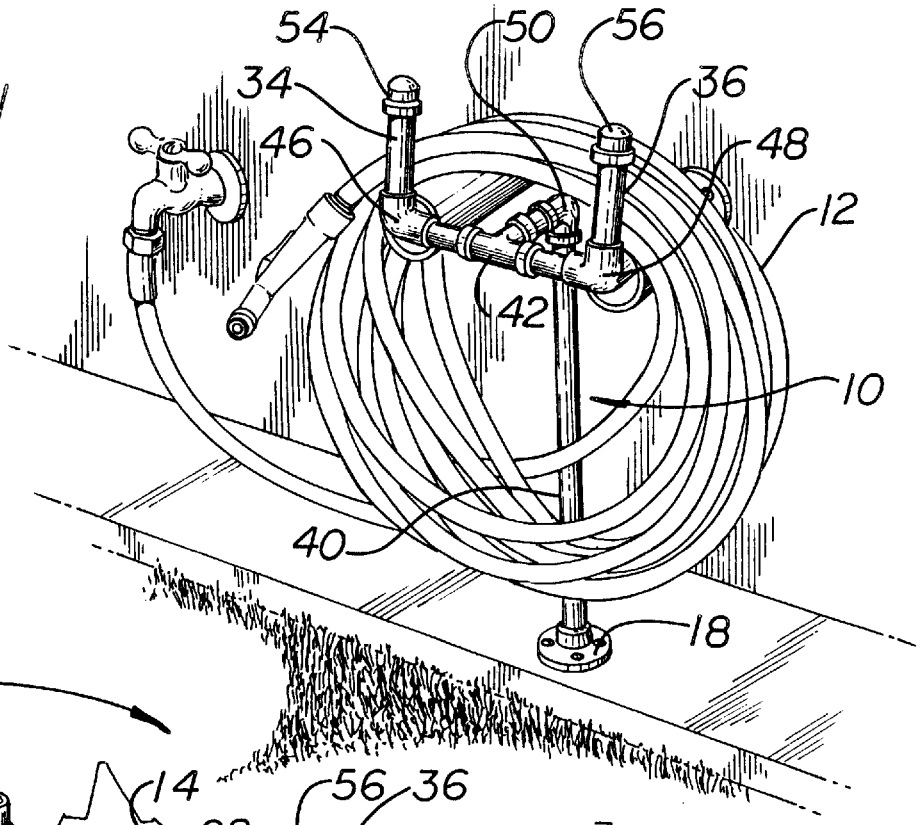
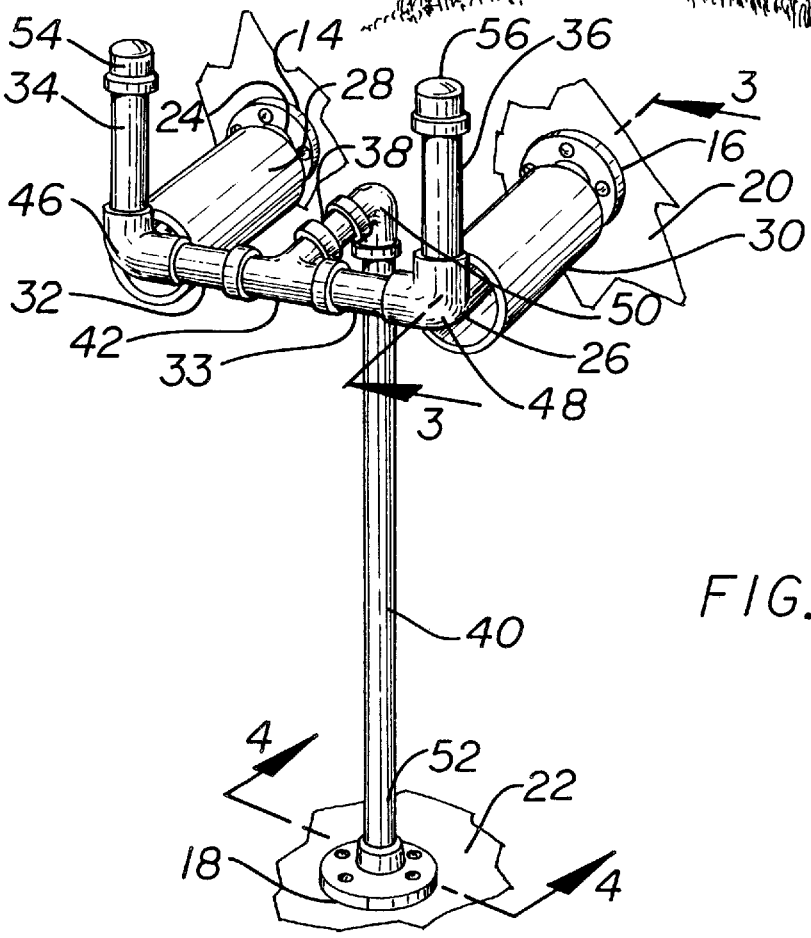
FIG. 2

WATER HOSE CADDY

REFERENCE TO RELATED APPLICATION

This application claims the benefit of U.S. Provisional Application No. 60/015,095 filed Apr. 10, 1996.

BACKGROUND OF THE INVENTION

1. Field of the Invention

The present invention relates generally storage devices, and more particularly to a method and apparatus for storing a water hose, such as a garden hose or the like, between uses.

2. Description of the Prior Art

It has long been desirable to provide a durable and stable storage device for water hoses, particularly garden hoses, which can be easily used and economically manufactured. Conventional water hose storage devices typically suffer from stability related problems. For example, metal water hose support racks, usually attached to a vertical support by two or more metal screws, tend to lose their form after usage thereby allowing the hose to fall off. Eventually, the metal water hose rack itself becomes disengaged from its anchorage.

Other types of conventional water hose storage devices such as plastic water hose reels, due to the brittleness of the plastic, start to break apart immediately after assembly and continue to deteriorate throughout the life of the device. Eventually, when left in the sun for years, plastic water hose reels tend to get hairline cracks or fail to function correctly in other manners. Metal water hose reels, though not subject to brittleness, will tend to deteriorate due to rusting. Consequently, the metal water hose reels start to pull apart or fail to function correctly.

Typical water hose storage devices for garden hoses and the like known to Applicant are exemplified by U.S. Pat. Nos. 4,506,698; 4,512,361; 4,586,676; 4,700,737; 4,836,479; 4,974,627; 5,005,790; 5,011,034; and 5,402,814. Water hose storage devices utilized in the prior art exemplified by the above-identified patents have thus been generally unsatisfactory. Even if the water hose storage devices are not subject to the forementioned problems, they nonetheless suffer from attendant disadvantages such as bulkiness, difficulty in use and/or complexity in design thus rendering the devices expensive to manufacture and maintain.

What is needed therefore is a water hose storage device which is simple and effective, and can be easily used and economically manufactured.

SUMMARY OF THE INVENTION

The preceding and other shortcomings of prior art products are addressed and overcome by the present invention which provides in a first aspect. An apparatus for storing a hose between periods of use, such as a water hose or other elongated flexible member, which includes right and left support arms, right and left rotatable support members, cross bar, right and left support posts, neck portion and base leg. The right and left rotatable support members are freely rotatable about said right and left support arms, thus allowing said hose to be freely uncoiled, and manufactured from polyvinyl chloride piping. The water hose support apparatus is mounted at three points such that it is securely supported in a vertical and horizontal position, and is preferably manufactured from galvanized pipe, and is constructed such that it can support the weight of the water hose and its contents when fully wrapped without any sagging or other failure.

In another aspect, the present invention provides an apparatus for storing a hose, comprising a generally vertically disposed base member for retaining the apparatus in a first direction, a horizontally disposed neck member connected to the base member, a cross bar member disposed generally centrally and perpendicularly from the neck member, first and second posts extending generally vertically and upwardly from ends of the cross bar member for retaining the hose on the apparatus, first and second arms extending generally horizontally from the ends of the cross bar member for supporting the hose on the apparatus and retaining the apparatus in a second direction, and first and second support members disposed about the first and second arms, respectively, for facilitating coiling and uncoiling of the hose.

In yet another aspect, the present invention provides an apparatus for storing an elongated flexible member, comprising a generally vertically disposed base nipple for retaining the apparatus in a vertical direction, a horizontally disposed neck nipple connected to the base nipple, a central nipple disposed generally centrally and perpendicularly from the neck nipple, first and second post nipples extending generally vertically and upwardly from ends of the central nipple for retaining the hose on the apparatus, first and second cap nipples disposed on the first and second post nipples, respectively, first and second arm nipples extending generally horizontally from the ends of the central nipple for supporting the hose on the apparatus and retaining the apparatus in a generally vertical direction, and first and second support members disposed about the first and second arm nipples, respectively, for facilitating coiling and uncoiling of the hose.

The foregoing and additional features and advantages of this invention will become apparent from the detailed description and accompanying drawing figures that follow. In the drawings and in the written description, numerals indicate the various features of the invention, like numerals referring to like features throughout for both the drawing figures and the written description.

BRIEF DESCRIPTION OF THE DRAWINGS

FIG. 1 is an elevational view of a water hose storage device including a water hose stored therein in accordance with the present invention;

FIG. 2 is a detailed elevational view of the water hose storage device illustrated in FIG. 1;

DETAILED DESCRIPTION OF THE PREFERRED EMBODIMENTS

Figure 3:
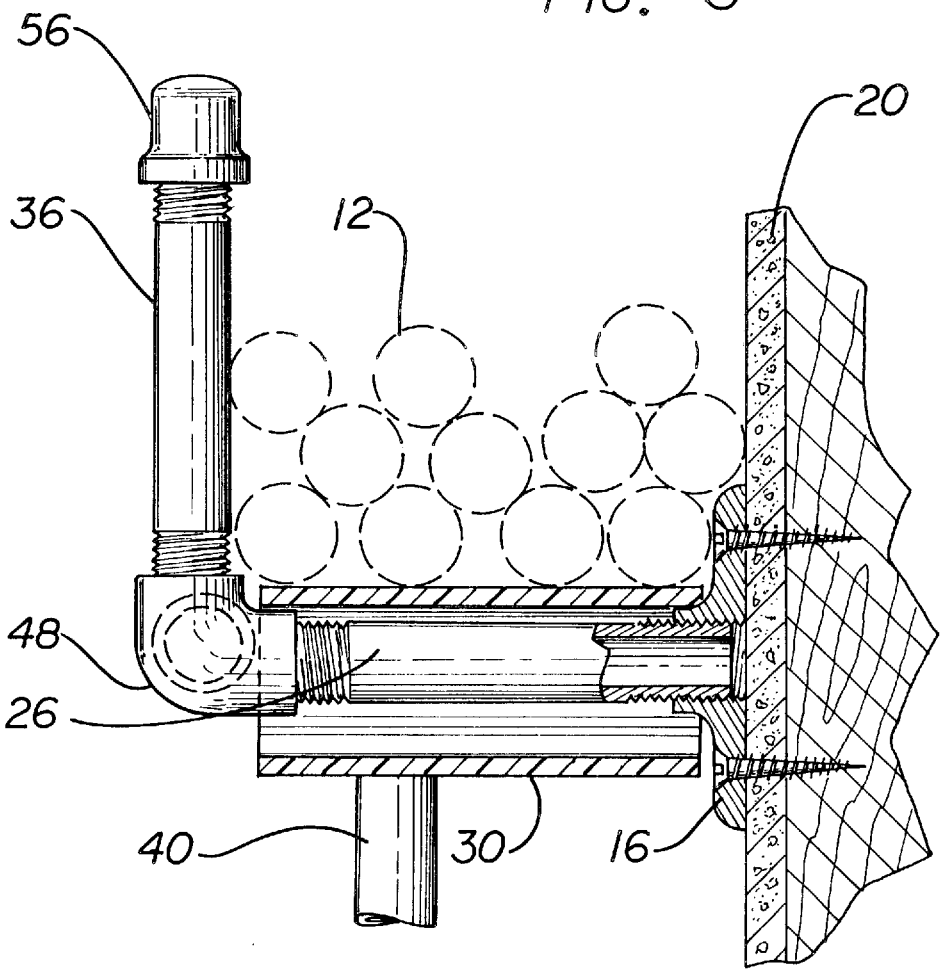
FIG. 3 is a cross-sectional view of the top portion of the water hose storage device including water hose stored therein illustrated in FIG. 2.

Referring to FIG. 1, there is shown generally a water hose storage device or caddy 10 for storing a hose 12 between periods of use, such as a garden hose or other elongated flexible member, constructed in accordance with the principles of the present invention. For illustrative purposes, the present invention is illustrated and described herein using a conventional garden hose 12. The present invention is not limited, however, to providing storage for a garden hose 12 between periods of use. Rather, the present invention may be used to provide storage for a variety of different flexible apparatus, including but not limited to commercial water hoses, tubing, wire, fiber, vacuum hoses, electrical cords, and the like.

As is shown in FIGS. 1 and 2, the water hose storage device 10 is mounted by way of left and right arm flange members 14 and 16 to a generally vertical surface 20 which may include, but is not limited to, a block, stucco, brick, wood or other kind of surface. The water hose storage device 10 is additionally mounted by way of base flange member 18 to a generally horizontal surface 22 which may include, but is not limited to, a concrete slab, deck, concrete pedestal, brick, wood or other kind of surface. It will be understood by one skilled in the art that the water hose storage device 10 may be mounted in other configurations as discussed in detail herein.

As is illustrated in FIG. 1, the water hose storage device 10 is illustrated mounted adjacent to a faucet with one end of the water hose 12 connected to the faucet and the other end (the free end) supported by the water hose 12 storage device. One skilled in the art will appreciate that the water hose storage device 10 may be mounted at any convenient location to store all or part of a water hose 12.

Referring to FIGS. 1 and 2, the water hose support device includes right and left hose support arms 24 and 26, rotatable hose support members 28 and 30, cross bar members 32 and 33, right and left hose support posts 34 and 36, neck member 38 and base member 40. Center tee 42 and elbows 46, 48 and 50 provide interconnection for the water hose support device 10. Right and left hose support posts 34 and 36 are capped on the upper end by caps 54 and 56.

Figure 4:
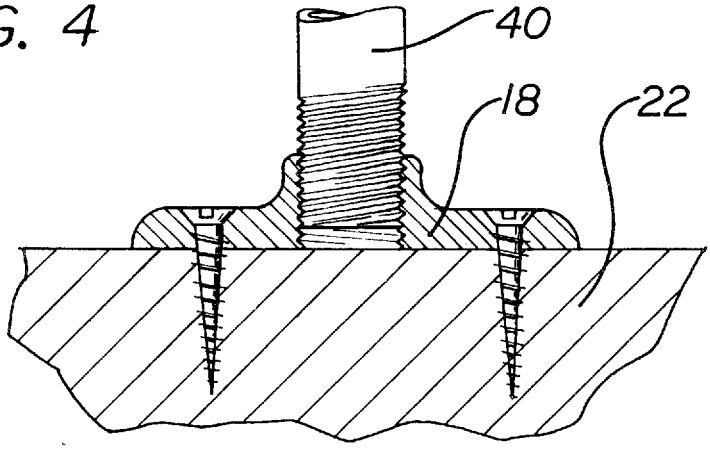
FIG. 4 is a cross-sectional view of the bottom portion of the water hose storage device illustrated in FIG. 2.

As is illustrated in FIG. 2, the base member 40 extends generally vertically upwardly and preferably includes the base flange member 18 mounted on one end 52 thereof. The base member 40 is preferably a nipple or pipe coupling including threaded tubing at each end. In a typical configuration, the base member 40 is a galvanized nipple having a length in the range 24" to 36" and an outer diameter of ¾". In accordance with an advantage of the present invention, the water hose support device 10 is adjustable in that the length of the base member 40 may be adjusted to obtain the desired elevation for the water hose support device 10. Referring now more specifically to FIG. 4, one end 52 of the base member 18 threadingly engages the base flange member 40, which may be mounted to a generally horizontal surface 22, such as a concrete slab or ground. The base flange member 40 is preferably galvanized floor flange. In a typical configuration, the base flange member 40 is an approximately ¾" galvanized floor flange.

Connected to the other end of the base member 40 is one end of an elbow 50, preferably a galvanized elbow. In a typical configuration, the elbow 50 is an approximately ¾" galvanized elbow. Connected to the other end of the elbow, is a generally horizontally disposed neck member 38 The neck member 38 is preferably a nipple or pipe coupling including threaded tubing at each end. In a typical configuration, the neck member 38 is an approximately ¾" diameter, 2½" length galvanized nipple.

Connected to the other end of the neck member 38 is a center tee 42, preferably a galvanized tee generally horizontally disposed. In a typical configuration, the center tee 42 is an approximately ¾" galvanized tee. Connected to the other two openings of the center tee 42 are cross bar members 32 and 33 which extend horizontally from the center tee 42. The cross bar members 32 and 33 are preferably nipples or pipe couplings including threaded tubing at each end. In a typical configuration, the cross bar members are each approximately ¾" diameter, 3½" length galvanized nipples.

As is illustrated in FIG. 2, the other end of each of the cross bar members 32 and 33 is connected to elbows 46 and 48, respectively. Elbows 46 are preferably galvanized elbows which in a typical configuration are 90° in bend. Elbows 46 and 48 are each disposed such that one end is disposed generally upwardly and vertically, at a 90° angle relative to the other two ends of the elbow which are generally horizontally disposed.

Connected to each generally upwardly and vertically openings of the elbows 46 and 48 are generally upwardly and vertically extending support posts 34 and 36, respectively. Right and left support posts 34 and 36 prevent the hose from inadvertently falling off the water hose storage device 10 while stored. Right and left support posts 34 and 36 are preferably nipples or pipe couplings including threaded tubing at each end. In a typical configuration, the support posts 34 and 36 are each approximately ¾" diameter, 6" length galvanized nipples. Right and left hose support posts 34 and 36 are capped on one end by caps 54 and 56, which are preferably galvanized caps and in a typical configuration are approximately ¾" galvanized caps.

As is illustrated clearly in FIGS. 2 and 3, connected to the generally horizontally disposed ends of elbows 46 and 48 are left and right support arms 24 and 26, which facilitate support of the hose 12 (shown in phantom lines). Right and left support arms 24 and 26 are preferably nipples or pipe couplings including threaded tubing at each end. In a typical configuration, the support arms 24 and 26 are each approximately ¾" diameter, 6" length galvanized nipples.

Installed about each support arm 24 and 26 is a rotatable hose support member 28 and 30, which is a generally hollow cylindrical members for assisting coiling and recoiling of the hose. In particular, the rotatable hose support members 28 and 30 insure that weather extremes, cold or hot, will not prevent the hose from being easily coiled without kinking. There is little opportunity for heat or ice to build up on or around the hose because it is always open to the atmosphere around. The rotatable support members 28 and 30 are preferably manufactured from polyvinyl chloride (PVC) piping, although other durable piping material including but not limited to thermoplastic conduits, tubes, and pipes may be used as well. The rotatable hose support members are disposed such that they are freely rotatable about support arms 24 and 26, thus allowing a hose to be freely uncoiled and retrieved from the water hose support device 10. In a typical configuration, the rotatable support members 28 and 30 are approximately 2" diameter, 5½" length hollow PVC pipes.

As is shown in FIG. 1, the water hose storage device 10 is mounted by way of left and right arm flange members 14 and 16 to a generally vertical surface 20 which may include, but is not limited to, a block, stucco, brick, wood or other kind of surface. In particular, referring to FIG. 3, the ends of the support arms 24 and 26 are threadingly engaged to flange members 14 and 16, which may be mounted to a generally vertical surface 20. The flange members 14 and 16 are preferably galvanized flanges which in a typical configuration are approximately ¾" galvanized floor flanges.

In accordance with an advantage of the present invention, the size of the water hose support device 10 may be adjusted to accordingly accommodate the particular configuration of the water hose or other device to be stored. In particular, the length and diameter of the right and left hose support arms 24 and 26, rotatable hose support members 28 and 30, cross bar member 32, right and left hose support posts 34 and 36, neck member 38 and base member 40 may be changed to accommodate the particular configuration of the device to be stored. Thus, for example, to accommodate commercial water hose having a very long length and wide diameter, the different portions comprising the water hose support device may be lengthened and enlarged in dimension.

As is illustrated in FIG. 3, the water hose storage device 10 includes a water hose 12, illustrated in phantom lines, coiled around the storage device 10. In particular, the hose 12 is coiled and stored about in the rack about rotatable hose support members 28 and 30 which surround right and left hose support arms 24 and 26, respectively. When the hose 12 is to be uncoiled for use, the rotatable hose support members 28 and 30 rotate, at least in part, thus facilitating uncoiling of the hose 12. The hose 12 can thus be freely uncoiled. Right and left hose support posts 34 and 36 prevent the hose 12 from inadvertently falling off the water hose storage device 10.

Thus, once the water hose support device 10 is installed, a user can easily wrap the water hose 12 on the device 10 which will easily support the water hose 12. In accordance with an advantage of the present invention, the present invention is rigid and sturdy and able to take the normal physical vibration and banging associated with removing and wrapping a water hose 12. In particular, the water hose support device 10, with the exception of the rotatable support members 28 and 30, is preferably manufactured from galvanized piping which along with the particular design of the present invention provides durability, strength and stability. Consequently, deterioration and stability problems usually associated with water hose support devices are avoided. In addition, the water hose support device 10 can take the added load of the weight of water when water is turned on before the water hose is unwound from its support.

In accordance with an alternative embodiment of the invention, some or all of the members of the water hose support device 10 may be integrally formed, rather than formed with the separate members interconnected by the center tee 42 and elbows 46, 48 and 50.

In accordance with yet another alternative embodiment of the invention, instead of being mounted at three points i.e. the generally vertical wall at two points and the generally horizontal surface at one point, as shown in FIG. 1, the water hose support device 10 may be mounted on the generally horizontal surface thus allowing it to be a standalone device. In particular, the water hose support device 10 can be solely anchored at the base flange member 40. Thus, in accordance with an advantage of the invention, the water hose storage device 10 may be located anywhere on a user's property and adjusted such that it is the desired height.

It will be appreciated by persons skilled in the art that the present invention is not limited to what has been shown and described hereinabove, nor the dimensions of sizes of the physical implementation described immediately above. The scope of invention is limited solely by the claims which follow.

What is claimed is:

1. An apparatus for storing a hose, comprising:

a generally vertically disposed base member for retaining said apparatus in a first direction;

a horizontally disposed neck member connected to said base member;

a cross bar member disposed generally centrally and perpendicularly from said neck member;

first and second posts extending generally vertically and upwardly from ends of said cross bar member for retaining said hose on said apparatus;

first and second arms extending generally horizontally from said ends of said cross bar member for supporting said hose on said apparatus and retaining said apparatus in a second direction;

first and second support members disposed about said first and second arms, respectively, for facilitating coiling and uncoiling of said hose;

a base flange connected to an end of said base member for mounting said apparatus to a generally horizontal surface; and first and second arm flanges connected an end of first and second arms, respectively, for mounting said apparatus to a generally vertical surface.

2. The apparatus claimed in claim 1, wherein said first and second support members are freely rotatable about said first and second arms, thus allowing said hose to be freely uncoiled.

3. The apparatus claimed in claim 1, wherein said first and second support members are manufactured from polyvinyl chloride piping.

4. The apparatus claimed in claim 1, further comprising:

a first elbow for connecting said base member to said neck member.

5. The apparatus claimed in claim 4, further comprising:

a second elbow for connecting said cross bar member, first post and first arm together; and a third elbow for connecting said cross bar member, second post and second arm together.

6. The apparatus as claimed in claim 1, wherein said cross bar member further comprises:

first and second bar members generally equally disposed horizontally from said neck member.

7. The apparatus as claimed in claim 6, comprising:

a tee for connecting said first and second bar members to said neck member.

8. The apparatus as claimed in claim 7, further comprising a third elbow for connecting said cross bar member, second post and second arm together, wherein said base member, said neck member, said cross bar member, said first and second posts, said first and second arms, said first, second and third elbows and said tee are manufactured from galvanized piping.

9. An apparatus for storing an elongated flexible member, comprising:

a generally vertically disposed base nipple for retaining said apparatus in a vertical direction;

a horizontally disposed neck nipple connected to said base nipple;

a central nipple disposed generally centrally and perpendicularly from said neck nipple;

first and second post nipples extending generally vertically and upwardly from ends of said central nipple for retaining said member on said apparatus;

first and second cap nipples disposed on said first and second post nipples, respectively;

first and second arm nipples extending generally horizontally from said ends of said central nipple for supporting said hose on said apparatus and retaining said apparatus in a generally vertical direction;

first and second support members disposed about said first and second arm nipples, respectively, for facilitating coiling and uncoiling of said hose;

a first flange means connected to an end of said base nipple for mounting said apparatus to a generally horizontal surface; and second and third flange means connected to said first and second arm nipples, respectively, for mounting said apparatus to a generally vertical surface.

10. The apparatus claimed in claim 9, wherein said first and second support members are generally cylindrical with a hollow center such that they are freely rotatable about said first and second arm nipples, thus allowing said hose to be freely uncoiled.

11. The apparatus claimed in claim 9, wherein said first and second support members are manufactured from polyvinyl chloride piping.

12. The apparatus claimed in claim 9, further comprising:

a first elbow means for connecting said base nipple to said neck nipple, such that said base nipple and said neck nipple are generally perpendicular to one another.

13. The apparatus claimed in claim 12, further comprising:

second elbow means for connecting said central nipple, said first post nipple and said first arm nipple together such that they are generally perpendicular to one another;

third elbow means for connecting said central nipple, said second post nipple and said second arm nipple together such that they are generally perpendicular to one another; and a tee for connecting said first and second bar nipples to said neck nipple.

14. The apparatus as claimed in claim 13, wherein said base nipple, said neck nipple, said central nipple, said first and second post nipples, said first and second arm nipples, said first, second and third elbow means, and said tee are manufactured from galvanized piping.

15. The apparatus as claimed in claim 9, wherein said central nipple further comprises:

first and second bar nipples generally equally disposed horizontally from said neck nipple.

16. The apparatus as claimed in claim 9, comprising:

a tee for connecting said first and second bar nipples to said neck nipple.

* * * * *

UNITED STATES PATENT AND TRADEMARK OFFICE

CERTIFICATE OF CORRECTION

PATENT NO. : 5,806,814

DATED : September 15, 1998

INVENTOR(S) : Mark Viklund et al

It is certified that error appears in the above-indentified patent and that said Letters Patent is hereby corrected as shown below:

Column 4, line 31, delete "mountable" and insert therefor --mounted--

Signed and Sealed this

Tenth Day of April, 2001

*Attest:*

Nicholas P. Godici

NICHOLAS P. GODICI

*Attesting Officer*

*Acting Director of the United States Patent and Trademark Office*